US005347804A

United States Patent [19]

Stahlecker et al.

[11] Patent Number: 5,347,804

[45] Date of Patent: Sep. 20, 1994

[54] SPINNING MACHINE WITH DRIVABLE GUIDING BELTS FOR TRANSPORTING SLIVER

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 171,859

[22] Filed: Dec. 22, 1993

Related U.S. Application Data

[63] Continuation of Ser. No. 868,228, Apr. 14, 1993, abandoned.

[30] Foreign Application Priority Data

Apr. 26, 1991 [DE] Fed. Rep. of Germany ..... 4113636

[51] Int. Cl.[5] ..... D01H 13/04

[52] U.S. Cl. ..... 57/90; 57/281; 57/328

[58] Field of Search ..... 57/281, 90, 315, 328

[56] References Cited

U.S. PATENT DOCUMENTS

| | | | |
|---|---|---|---|
| 2,896,269 | 7/1959 | Gardella et al. | 57/315 X |
| 3,312,050 | 4/1967 | Noguera | 57/90 |
| 3,884,026 | 5/1975 | Yoshizawa et al. | 57/281 |
| 4,619,109 | 10/1986 | Suzuki et al. | 57/328 X |

FOREIGN PATENT DOCUMENTS

| | | | |
|---|---|---|---|
| 3325999 | 1/1984 | Fed. Rep. of Germany . | |
| 257429 | 11/1987 | Japan | 57/281 |
| 1015780 | 1/1966 | United Kingdom . | |

*Primary Examiner*—Joseph J. Hail

[57] ABSTRACT

In the case of a spinning machine having spinning stations arranged on one side of the machine and having depositing sites for cans containing the fiber material to be spun provided on the other side of the machine, devices are provided for the withdrawal and feeding of the slivers which have drivable guiding belts which extend from an area above the depositing sites to the area of the spinning stations.

18 Claims, 2 Drawing Sheets

Fig. 2
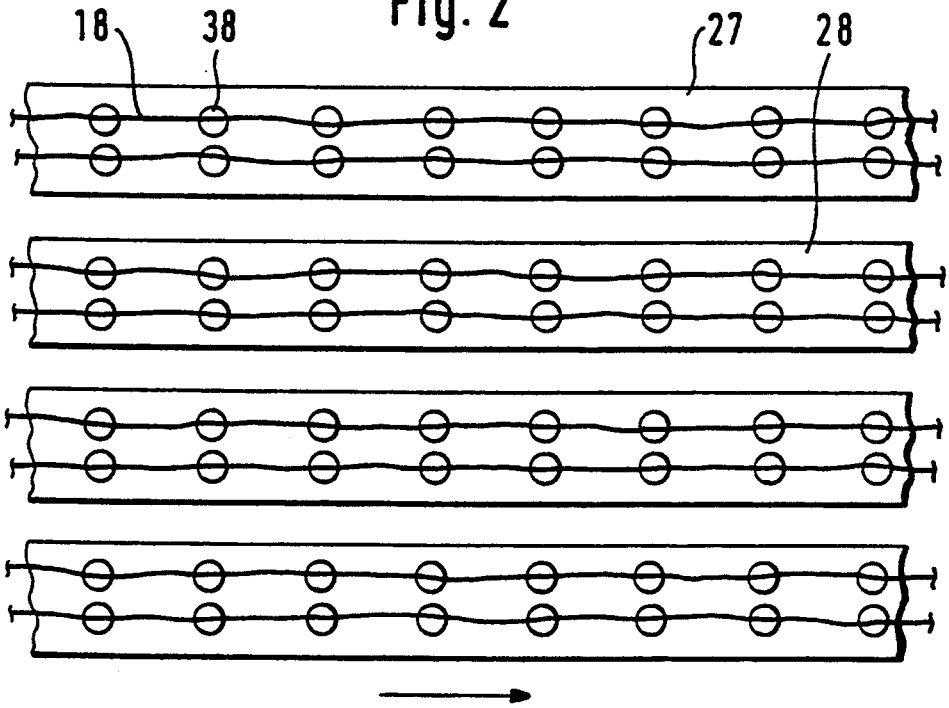
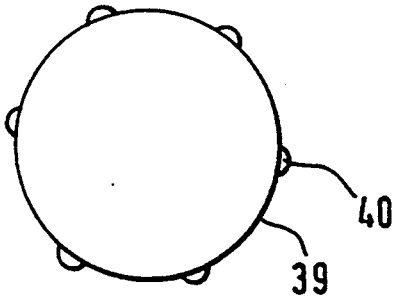
Fig. 3

SPINNING MACHINE WITH DRIVABLE GUIDING BELTS FOR TRANSPORTING SLIVER

This application is a continuation of application Ser. No. 08/868,228, filed on Apr. 14, 1993 now abandoned.

BACKGROUND AND SUMMARY OF THE INVENTION

This invention relates to a spinning machine having spinning stations arranged on one side of the machine in a row next to one another and having depositing sites provided on the other side of the machine for sliver supply cans. The sliver supply cans each contain a sliver to be spun and devices are provided for the withdrawal of the slivers from the cans and for feeding them to the spinning stations.

In the case of a known spinning machine of this type (German Patent Document DE-C 33 25 999), the spinning stations of which are constructed as air nozzle spinning units, the slivers are withdrawn from the cans in the upward direction by means of guiding pulleys. They will then extend essentially horizontally farther to additional guiding pulleys which are arranged in the area above the drafting units of the spinning stations. In the case of the machines used in practice, the guiding pulleys are driven at circumferential speeds which are higher than the feeding speed of the drafting units. In this case, the guiding rollers, which are second in the transport direction, have a slightly higher circumferential speed than the first guiding rollers. In the case of this design, it is assumed that such guiding rollers do not achieve any slippage-free taking-along of the slivers. This is taken into account by the fact that the guiding rollers run slightly faster than would be required for the transport of the slivers. In addition, it is avoided that the slivers are tensioned which would lead to the risk of undesirable drafts (faulty drafts). These slivers hang slightly through between the guiding rollers and also between the second guiding rollers and the drafting units. Despite these measures, there is the danger of faulty drafts, particularly after fairly long stoppage times, particularly because the moisture content of the slivers will then change during the stoppage time. It is therefore virtually only possible to feed relatively coarse slivers in this manner; that is, slivers of a size of Nm 0.25 and coarser ones.

In the case of a ring spinning machine, it is also known (British Patent Document GB-PS 10 15 780) to feed the slivers to be spun in cans from which the slivers are withdrawn in the upward direction by way of rollers. The slivers are then received between two transport belts respectively and are guided by these transport belts from the cans standing in front of the spinning machines, in the downward direction, from there below the bottom to the center of the ring spinning machine, and from there upwards to the drafting units.

It is an object of the invention to develop a spinning machine of the initially mentioned type such that the risk of faulty drafts of the fed slivers is largely excluded.

This object is achieved according to preferred embodiments of the invention in that the devices for the withdrawal and the feeding of the slivers have drivable guiding belts which extend from an area above the depositing sites to the area of the drafting units.

In the case of this construction, the slivers are supported by the guiding belts virtually along the whole transport area so that they do not hang through, and thus the danger of faulty drafts is largely avoided. It is possible in this manner to bridge relatively large distances without stressing the slivers by tension or the like. In addition, it is possible by means of these guiding belts to transport the slivers almost without slippage so that, also after a stoppage, at the time of a subsequent start of the operation, the slivers are fed virtually without any slippage.

In a further development of the invention, it is provided that the spinning stations are constructed as air spinning units to which one three-cylinder drafting unit respectively is assigned, and that the cans contain slivers of a size of approximately 0.4 Nm to approximately 0.8 Nm. By means of the invention, it is possible to also feed such fine slivers in such a manner that no faulty drafts occur despite this fineness. Because of the feeding of such fine slivers, the draft inside the three-cylinder drafting units is still relatively slight and can therefore be mastered well.

Other objects, advantages and novel features of the present invention will become apparent from the following detailed description of the invention when considered in conjunction with the accompanying drawings.

BRIEF DESCRIPTION OF THE DRAWINGS

FIG. 2 is a partial top view in the direction of the arrow II of FIG. 1; and FIG. 3 is a schematic view of a detail of a modified embodiment.

DETAILED DESCRIPTION OF THE DRAWINGS

Figure 1:
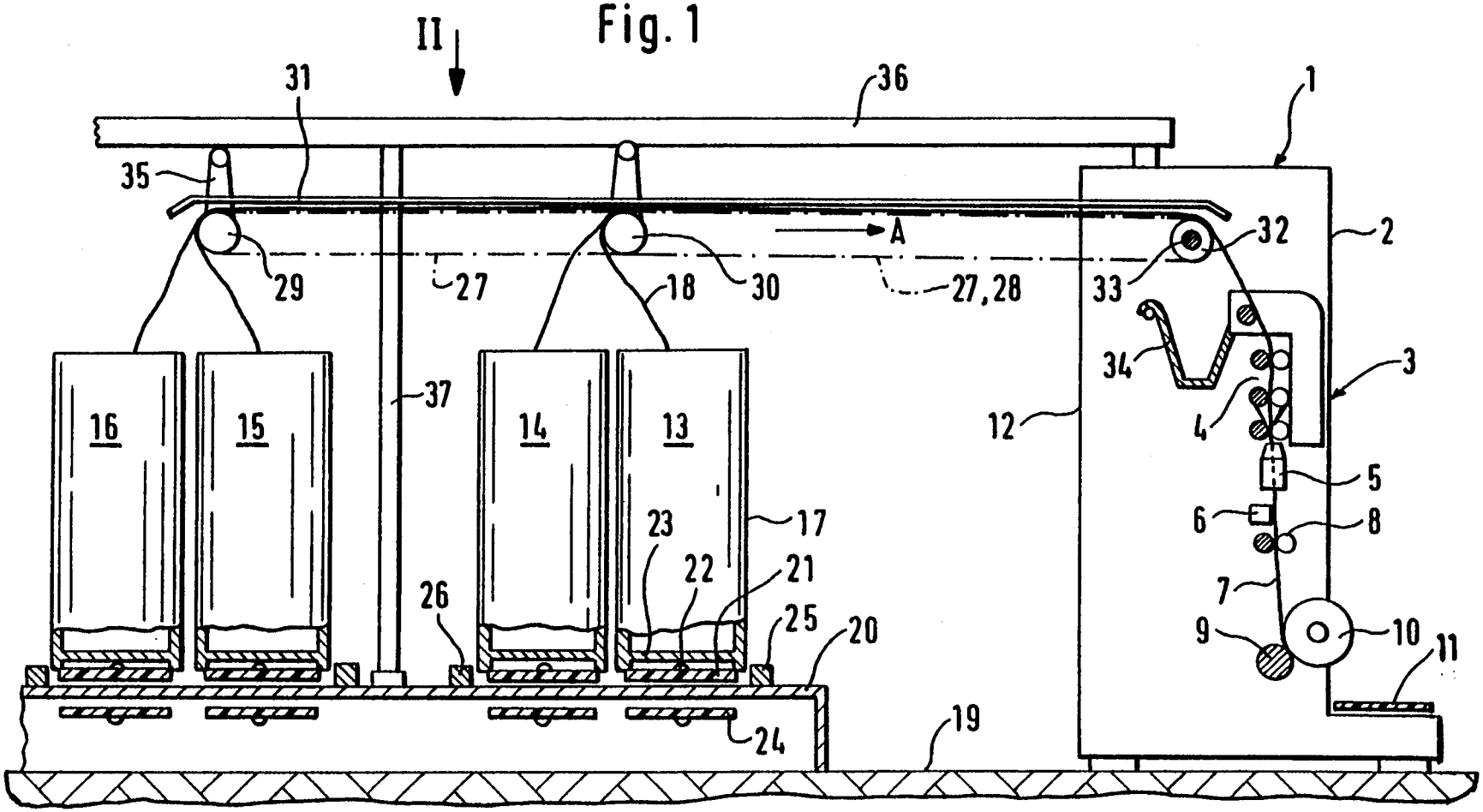
FIG. 1 is a partially sectional schematic view of an air spinning machine which is provided with air spinning units on the front side and is provided with depositing sites for sliver supply cans on the rear side, constructed according to a preferred embodiment of the invention.

FIG. 1 illustrates an air nozzle spinning machine 1 only schematically. On its front side 2, it is provided with a plurality of spinning stations 3 arranged in a row next to one another. Each spinning station 3 comprises a three-cylinder drafting unit 4, at least one pneumatic false-twisting nozzle 5, a yarn detector 6 for the spun yarn, a pair of withdrawal rollers 8, as well as a winding roller 9 which winds the spun yarn 7 into a package 10. On the front side 2, in the lower machine area, there is also a conveyor belt 11 which extends in the longitudinal direction of the machine and is used for the receiving and moving-away of full packages 10 in the case of exchanges of tubes and packages.

Each of the spinning stations 3 may be constructed such that it spins a sliver 18 into a yarn 7 which is wound up as a package 10. In the case of a preferred embodiment, it is, however, provided that the spinning stations 3 are constructed as so-called double spinning stations which spin two yarns which are wound up side by side as a double yarn onto the package 10. In this case, the double spinning stations each have two drafting units which are assigned to common pressure roller twins which are held by a common bearing and loading arm. A pneumatic false-twisting nozzle 5 as well as a yarn detector 6 is assigned to each of the two individual yarns. Subsequently, the two individual yarns are guided together and are withdrawn together as a double yarn by the withdrawal rollers 8 and are then wound up as a double yarn.

In both cases, relatively fine slivers are spun with sizes of approximately 0.4 Nm to approximately 0.8 Nm so that the drafts up to a desired yarn size can easily be applied by the three-cylinder drafting units 4.

The slivers 18 are fed in cans 17 which are deposited on depositing sites which are situated on the rear side 12 of the machine. Because of the relatively large diameters of the cans 17, which exceed the spacing of the machine; that is, the distance from a center of a spinning station to the center of another adjacent spinning station, the cans 17 are deposited on the depositing sites in a total of four rows 13, 14, 15, 16. The depositing sites are part of a platform 20 which is slightly elevated with respect to the mill floor 19. Transport belts 21, 24 are integrated into the platform 20, one run 21 of these transport belts extending on the top side of the platform 20, and the returning run 24 of the transport belts being guided inside the platform 20. These transport belts 21, 24, which are guided around deflection pulleys and driving pulleys which are not shown form the depositing sites for the cans 17 on the one hand while they are also used for the feeding of full cans 17 and for the removal of empty cans 17 on the other hand. As illustrated in FIG. 1, the rows 13, 14; 15, 16 of the cans 17 are arranged in pairs. It is also contemplated to provide, instead of four transport belts, only two transport belts which will then receive two rows 13, 14; 15, 16 of cans 17.

The transport belts 21, 24 are provided with convex, button-type take-along devices 22 which reach under the bottom edge of the cans 17; in which case it is assumed that in the case of such cans 17, the can bottom 23 is generally slightly set back with respect to the lower edge. These take-along devices 22 are therefore used for the positioning of the cans 17. Laterally, the cans 17 are guided between guiding rails 25, 26 which are arranged on the platform 20.

In order to securely withdraw the fine slivers 18 from the cans 17 and to feed them without any draft to the drafting units 4 of the spinning stations 3, this withdrawal and feeding takes place by means of drivable guiding belts 27, 28 which extend from the area above the rows 13, 14; 15, 16 of the cans 17 to the area above the drafting units 4. The width of the transport belts 27, 28, as illustrated in FIG. 2, is designed such that two slivers 18 respectively are received by one of the transport belts 27, 28 and are transported. In this case, one transport belt 27, 28 respectively is assigned to one of the double rows 13, 14; 15, 16 of depositing sites, in which case, the two slivers 18 transported by the transport belts 25, 28 each travel to the drafting units which have common pressure roller twins.

The guiding belts 27, 28 travel around deflection pulleys 29, 30 which are arranged approximately in the center with respect to the double rows 13, 14; 15, 16 of the depositing sites for cans 17. This means that the transport belt 28 assigned to the double row 13, 14 is shorter than the transport belt 27 assigned to the double row 15, 16. In the area above the drafting units 4, additional deflection pulleys 32 are disposed which are non-rotatably arranged on a shaft 33 which extends in the longitudinal direction of the machine and is driven, for example, by the driving motor which also drives the drafting units 4.

As illustrated in FIG. 1, the guiding belts 27, 28, on which the slivers 18 are transported, extend essentially horizontally. However, it is also within the scope of the invention to guide the transport belts 27, 28, starting from the rows 13, 14; 15, 16 of the depositing sites with a slight slope to the area above the drafting units 4 in order to shorten the free height between the cans 17 and the deflecting rollers 29, 30. The platform 20 also contributes to the shortening of this free length.

The deflection rollers 29, 30 are held in a machine frame which is formed of transverse bars 36 which are supported on the frame of the air spinning machine 1 and, by way of supports 37, on the platform 20. The bars 36 are equipped with holders 35 for the deflection rollers 29, 30.

In order to exclude that the slivers 18 during the transport move relative to the belts 27, 28, for example, because of air flows or the like, additional devices are provided which fix the slivers 18 on the guiding belts 27, 28. For this purpose, the embodiment provides skids 31 in parallel to the runs of the guiding belts 27, 28 on which the slivers 18 rest, these skids 31 being pressed against the transport belts 27, 28 with a slight force. In addition, the transport belts 27, 28 are provided with profilings which may, for example, be recesses 38 (FIG. 2). These recesses 38 provide that the slivers 18 are guided by the guiding belts 27, 28 with a certain form-locking. In addition, these recesses 38 may also be utilized to provide a drive of the guiding belts 27, 28 that is free of slippage. In this case, the drivable deflection rollers 39, which are arranged in the area of the spinning machine 1 and are shown in FIG. 3, are provided with corresponding cams 40 which engage in the recesses 38 in the manner of teeth.

As a deviation from the shown embodiment, the skids 31 are not used. In this case, deflection rollers 39 are arranged at a short distance behind the deflection rollers 29, 30 corresponding to FIG. 3, these deflection rollers 39, by means of their cams 40, slightly pressing the slivers 18 into the recesses 38 so that these are fixed in this manner.

In the area between the transport belts 27, 28 ending in the spinning machine 1 and the drafting units 4, a device is provided by means of which the entering slivers 18 can be stored intermediately. This device comprises a collecting trough 34 which in a preferred manner extends along several spinning stations 3. In this collecting trough 34, the slivers 18, which were placed on the guiding belts 27, 28, are first collected until they are taken out by an operator or an automatic machine and are introduced into the drafting units 4. The collecting trough 34 is disposed outside the normal travelling path of the slivers 18 in a position disposed underneath so that the slivers 18, in the case of a feeding by means of guiding belts 27, 28 automatically travel into the collecting troughs 34.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A one-sided air spinning machine comprising:

a plurality of air spinning stations arranged on one side of the machine in a row next to one another, each air spinning station including a drafting unit, depositing sites provided on the other side of the machine for sliver supply cans, which sliver cans each contain a sliver to be spun, and withdrawal devices for the withdrawal of the slivers from the cans and for feeding the slivers to the drafting units of the air spinning stations, wherein the devices for the withdrawal and feeding of the slivers comprise drivable guiding belts which are approximately horizontally arranged and which extend horizontally directly from an area above the depositing sites to the area of the air spinning stations.

2. An air spinning machine according to claim 1, wherein the air spinning stations each include one three-cylinder drafting unit, and wherein the cans contain slivers of size of from 0.4 Nm to 0.8 Nm.

3. An air spinning machine according to claim 2, wherein the depositing sites are arranged in double rows, and wherein the guiding belts, which are arranged behind one another in the longitudinal direction of the machine, are each assigned to a double row.

4. An air spinning machine according to claim 3, wherein the guiding belts each have a width for accommodating the transport of two slivers.

5. An air spinning machine according to claim 4, wherein storing devices are arranged between the ends of the guiding belts on the spinning stations for receiving and intermediately storing slivers.

6. An air spinning machine according to claim 5, wherein sliver securing devices are provided for the securing of the slivers which hold the slivers on the guiding belts.

7. An air spinning machine according to claim 6, wherein the guiding belts are provided with profilings, and wherein pressing devices are provided for pressing the slivers into the profilings.

8. An air spinning machine according to claim 6, wherein slideways are assigned to conveying runs of the guiding belts, which slideway extend essentially in parallel to the guiding belts.

9. An air spinning machine according to claim 8, wherein the depositing sites are formed by transport belts extending in the longitudinal direction of the machine.

10. An air spinning machine according to claim 9, wherein the transport belts are provided with take-along devices which fix the positions of the cans.

11. An air spinning machine according to claim 1, wherein the depositing sites are arranged in double rows, and wherein the guiding belts, which are arranged behind one another in the longitudinal direction of the machine, are each assigned to a double row.

12. An air spinning machine according to claim 1, wherein the guiding belts each have a width for accommodating the transport of two slivers.

13. An air spinning machine according to claim 1, wherein storing devices are arranged between the ends of the guiding belts on the spinning stations for receiving and intermediately storing slivers.

14. An air spinning machine according to claim 1, wherein sliver securing devices are provided for the securing of the slivers which hold the slivers on the guiding belts.

15. An air spinning machine according to claim 14, wherein the guiding belts are provided with profilings, and wherein pressing devices are provided for pressing the slivers into the profilings.

16. An air spinning machine according to claim 14, wherein slideways are assigned to conveying runs of the guiding belts, which slideway extend essentially in parallel to the guiding belts.

17. An air spinning machine according to claim 1, wherein the depositing sites are formed by transport belts extending in the longitudinal direction of the machine.

18. An air spinning machine according to claim 17, wherein the transport belts are provided with take-along devices which fix the positions of the cans.

* * * * *

UNITED STATES PATENT AND TRADEMARK OFFICE

CERTIFICATE OF CORRECTION

PATENT NO. : 5,347,804

DATED : September 20, 1994

INVENTOR(S) : Stahlecker et al.

It is certified that error appears in the above-indentified patent and that said Letters Patent is hereby corrected as shown below:

On the title page item [63], change "Apr. 14, 1993" to --Apr. 14, 1992--.

Column 1, line 6, change "1993" to --1992--.

Signed and Sealed this

Thirty-first Day of January, 1995

*Attest:*

*Attesting Officer*

BRUCE LEHMAN

*Commissioner of Patents and Trademarks*